US006776202B1

(12) United States Patent
Dziesinski et al.

(10) Patent No.: US 6,776,202 B1
(45) Date of Patent: Aug. 17, 2004

(54) LOG PEELING APPARATUS

(75) Inventors: Alan Chester Dziesinski, Ossineke, MI (US); Randy William Patterson, Alpena, MI (US)

(73) Assignee: W.G. Benjey, Inc., Alpena, MI (US)

( * ) Notice: Subject to any disclaimer, the term of this patent is extended or adjusted under 35 U.S.C. 154(b) by 0 days.

(21) Appl. No.: 10/243,398

(22) Filed: Sep. 16, 2002

(51) Int. Cl.[7] ..... B27L 1/10
(52) U.S. Cl. ..... 144/208.1; 144/208.4; 144/208.5
(58) Field of Search ..... 144/208.1, 208.4, 144/208.5, 208.6, 341, 250.25; 47/1.01

(56) References Cited

U.S. PATENT DOCUMENTS 2,841,195 A * 7/1958 Fulghum ..... 144/208.6
3,176,734 A * 4/1965 Broadbent ..... 144/208.6
4,036,270 A 7/1977 Bright
4,211,394 A * 7/1980 Sampson ..... 269/239
4,249,585 A * 2/1981 Mellott ..... 239/690.1
4,425,952 A 1/1984 Pousette et al.
4,875,511 A 10/1989 Wingate-Hill et al.
5,638,878 A * 6/1997 Weirathmueller ..... 144/208.6

* cited by examiner

*Primary Examiner*—Allen Ostrager
*Assistant Examiner*—Shelley Self
(74) *Attorney, Agent, or Firm*—Harpman & Harpman

(57) ABSTRACT

A log-peeling machine for removing bark from logs to simulate hand peeled logs. A log is held in position on a pair of movable log support frames, each having multiple adjustable log support and drive roller assemblies. An independent high-speed cutting head is movable along the length of the log removing bark in longitudinal strips by adjustably following the log surface which is raised and lowered and rotated for engagement with the cutting head.

4 Claims, 19 Drawing Sheets

LOG PEELING APPARATUS

BACKGROUND OF THE INVENTION

1. Technical Field

This device relates to bark removing machines that are used to process logs for use in the log structures. The bark must be removed before the logs can be used in the log building industry. Historically, bark was removed by hand by use of a drawknife or by a broad axe when the log was hand honed into support beans and the like.

2. Description of Prior Art

Prior art machines for rapidly removing bark can be found in sawmills, for example, in which large automated debarkers are used to grind and strip the bark from logs prior to milling. Such devices as drum debarkers use a rotating drum with a plurality of internal bark engagement ribs. As the log passes through the drum, they strike the ribs and other logs removing the bark. Other log debarking devices can be seen, for example, in U.S. Pat. Nos. 3,987,825, 4,036,270, 4,249, 585, 4,425,952 and 4,875,511.

In U.S. Pat. No. 3,987,825 a tree bark removing apparatus is disclosed having two rows of oppositely disposed angularly aligned log transportation wheels and a fixed overhead cutting head. The logs are advanced longitudinally and engaged by the rotating tool removing the bark.

U.S. Pat. No. 4,036,270 disclosed a log peeling machine having a rotary peeling drum assembly with in feed and out feed conveyors that engage both the top and bottom surface of the logs directing it for engagement with the rotating bark removing drum.

A log debarking apparatus is claimed in U.S. Pat. No. 4,249,585 in which a log is rotated in a fixed longitudinal position while a debarking tool is moved along the log in a spiral path.

In U.S. Pat. No. 4,425,952 a log feeding apparatus is shown having a pair of support arms with three log feed assemblies positioned thereon. Each assembly has a rotating drum with a plurality of log engaging spikes on its outer surface.

A bark removing apparatus is shown in U.S. Pat. 4,875, 511 in which multiple pairs of concave rollers engage oppositely disposed surfaces of the log, removing the bark therefrom.

SUMMARY OF THE INVENTION

A log peeling device which selectively engages a log, removing longitudinal strips of bark. It is advantageous to remove bark in this fashion on logs to be used in log home construction giving the logs a hand peeled look which heretofore was only possible by labor intensive hand debarking. Logs are held in fixed longitudinal position on a vertically adjustable support table and engaged along their longitudinal axis by a movable overhead cutting head. A log chuck selectively rotates the log, repositioning it for the cutting head which has a plurality of blades on a central arbor that engage the presented log surface removing the bark as it is passed over the surface of the log.

DESCRIPTION OF THE PREFERRED EMBODIMENTS

Figure 1:
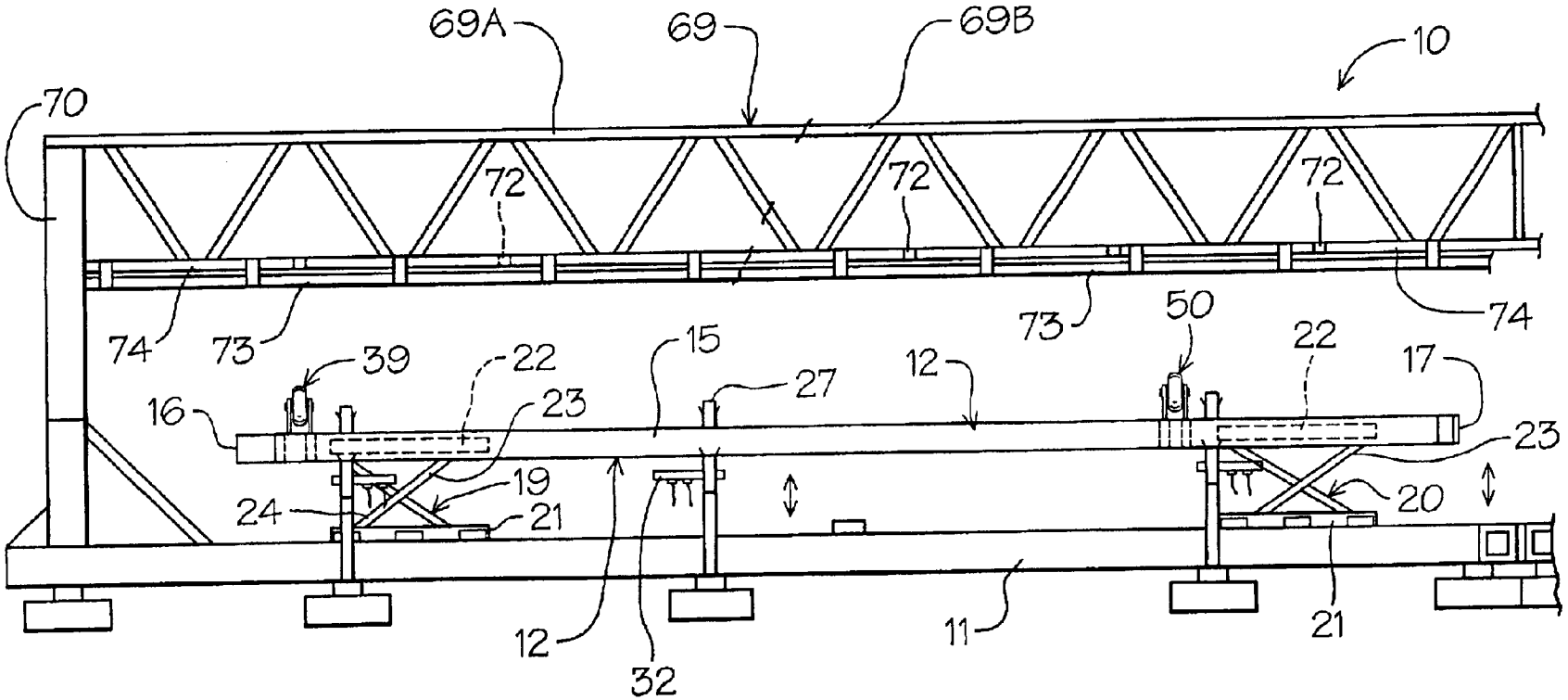
FIG. 1 is a partial side elevational view of the log peeling apparatus of the invention.
Figure 2:
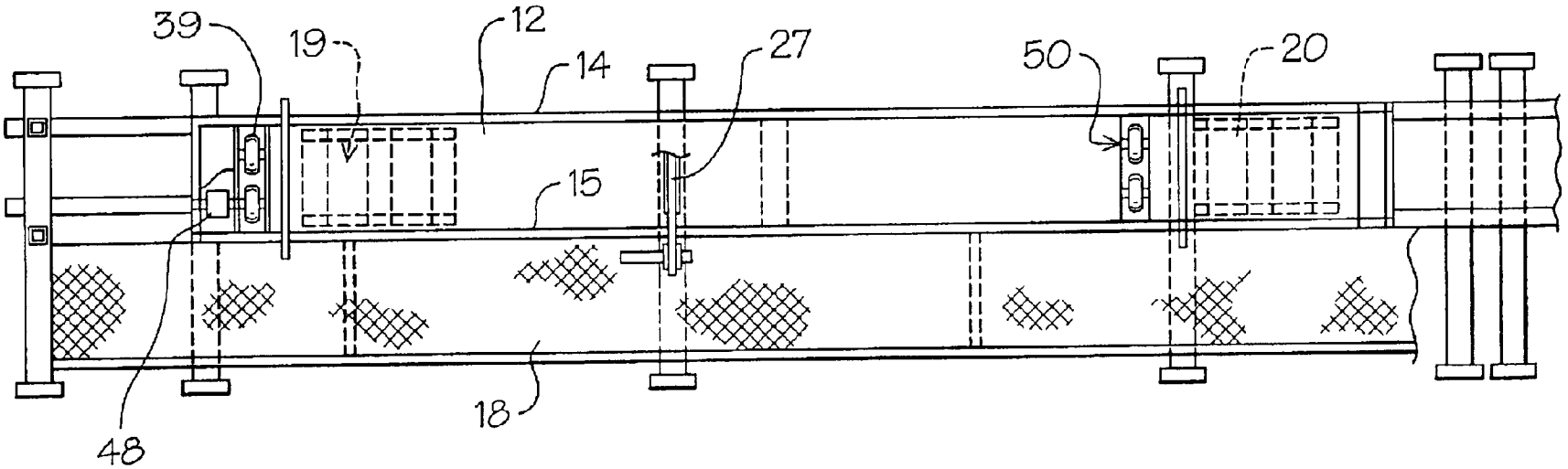
FIG. 2 is a partial top plan view of FIG. 1.
Figure 3:
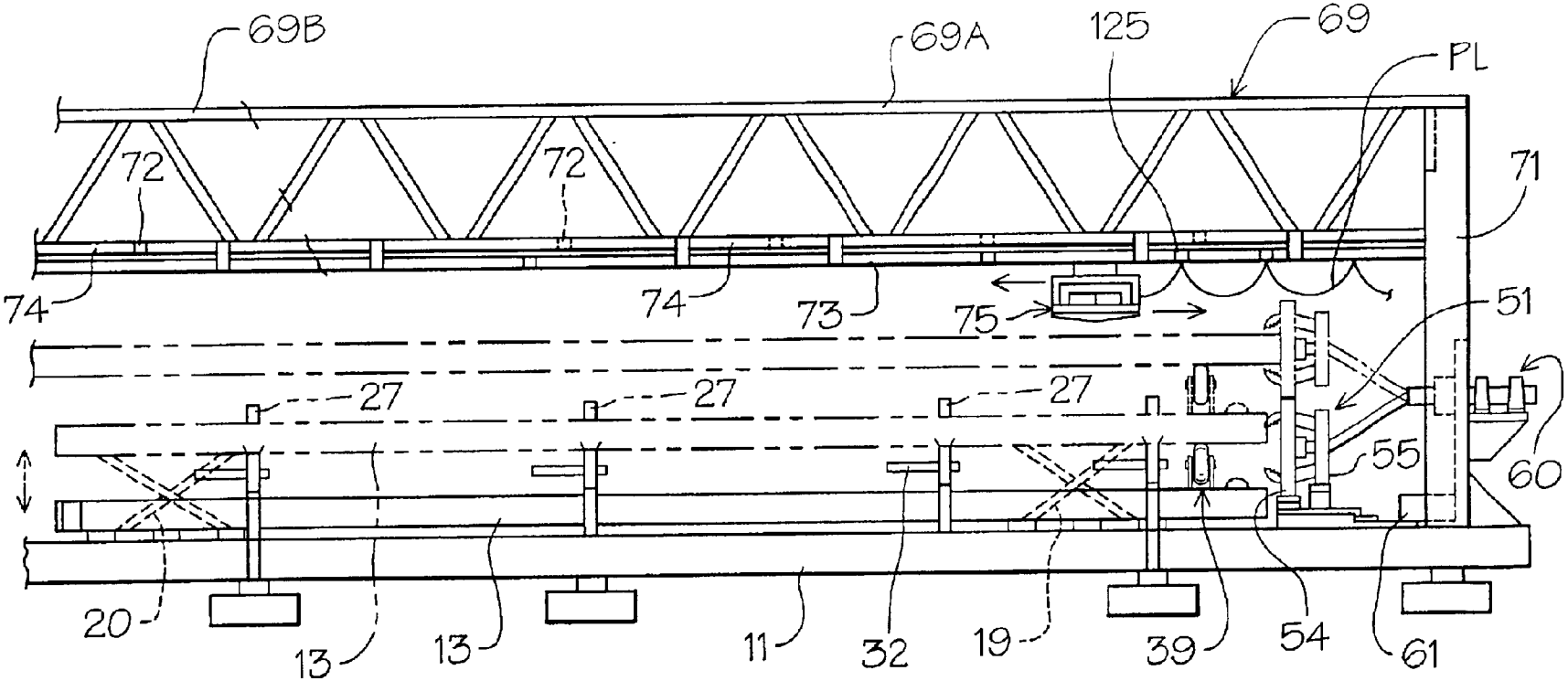
FIG. 3 is a partial side elevational view of the log peeling apparatus of the invention.
Figure 4:
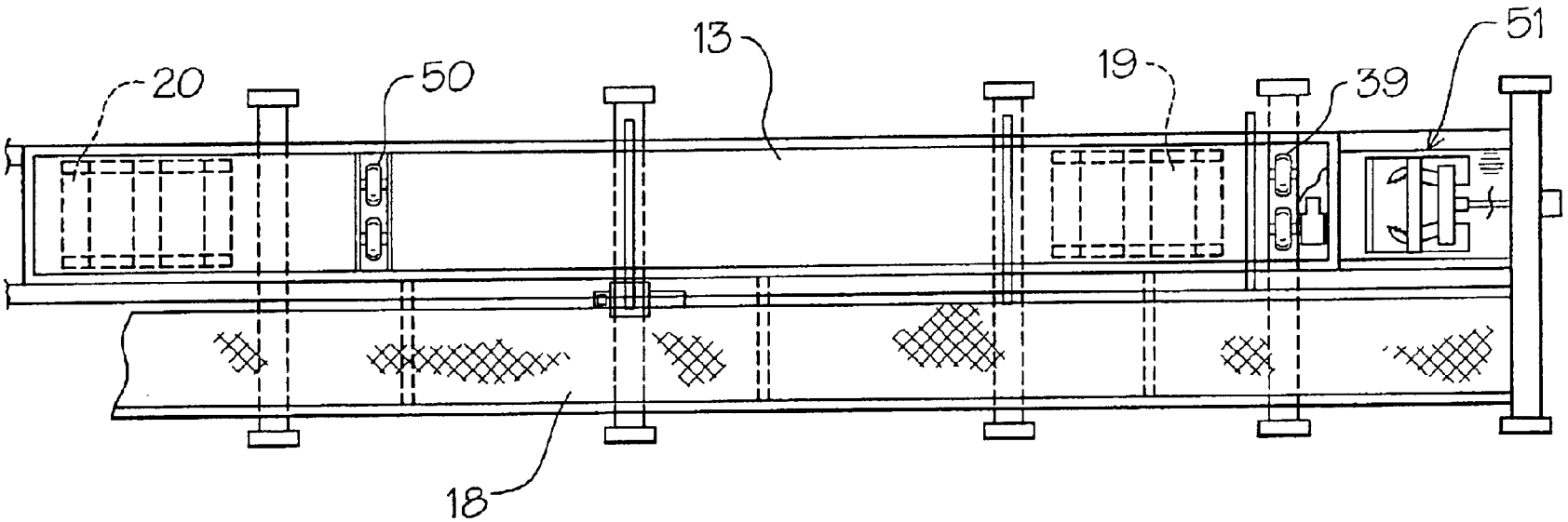
FIG. 4 is a partial top plan view of FIG. 3.

Referring to FIGS. 1–5 of the drawings, a log peeling apparatus 10 can be seen having a rectangular main base support frame 11. A pair of elongated longitudinally aligned lift tables 12 and 13 are positioned within the main base support frame 11. Each of the lift tables 12 and 13 is generally rectangular having oppositely disposed parallel side frames 14 and 15 and interconnecting oppositely disposed end frames 16 and 17. An operator support walkway 18 extends along the length of the main base support frame 11 outwardly from an interconnecting the respective lift tables 12 and 13 as best seen in FIGS. 2 and 4 of the drawings.

Each of the lift tables 12 and 13 has a pair of oppositely disposed powered scissor lift assemblies 19 and 20 engageable thereunder inwardly of the table's respective end frames 16 and 17. The scissor lifts 19 and 20 have a base 21 and an upper engagement frame 22 interconnected by pairs of cross-pivoted support arms 23 and 24. A pair of hydraulic piston and cylinder assemblies 25 and 26 are engaged on a cross beam 27 for vertical activation of the upper engagement support frame 22 best seen in FIG. 7 of the drawings.

Figure 7:
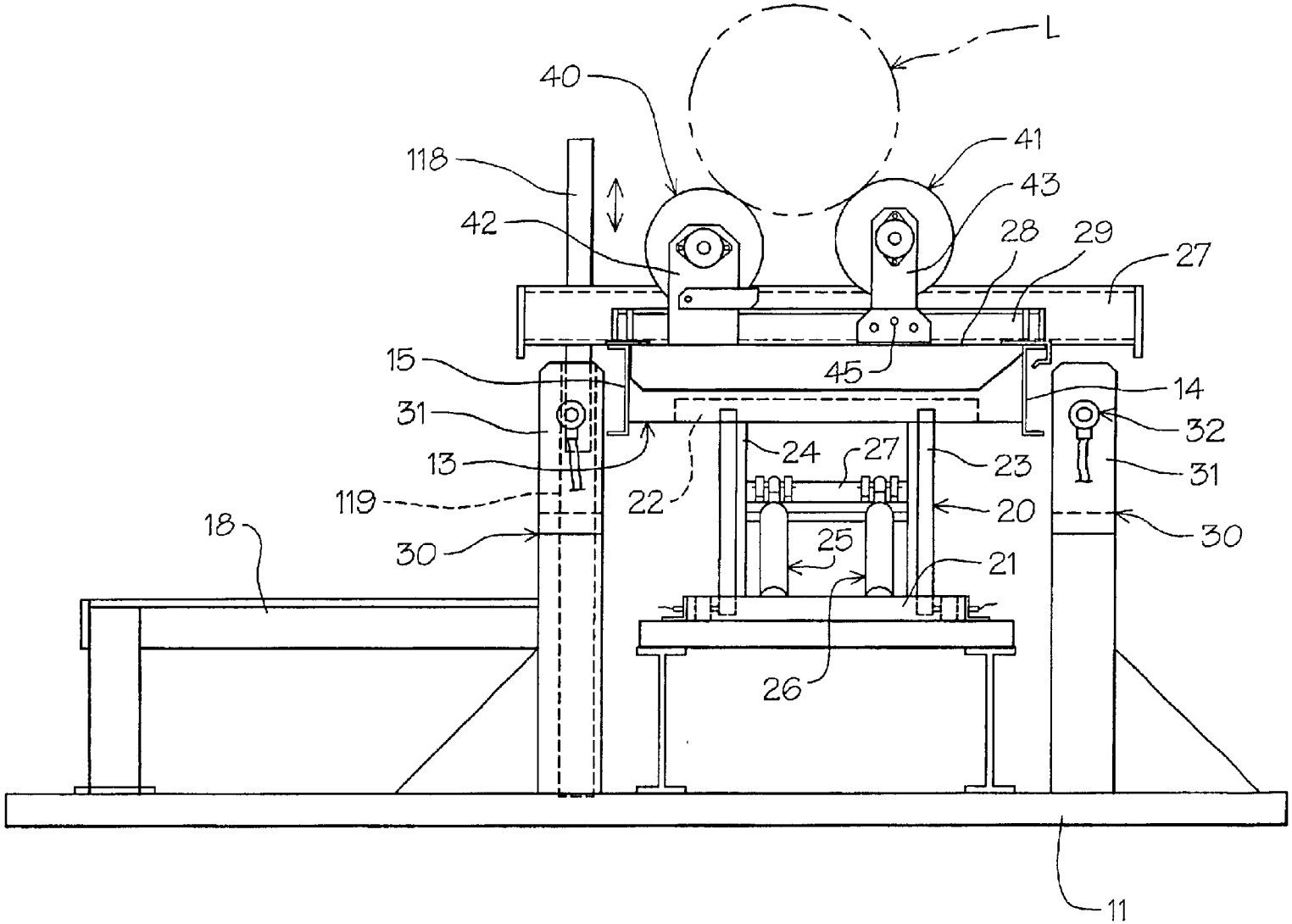
FIG. 7 is an end elevational view of a log support portion of the invention showing a log, in broken lines, thereon, ready for processing.

The lift tables 12 and 13 each have a plurality of longitudinally spaced material engagement beams 27 extending transversely thereacross as seen in FIGS. 1–3 of the drawings. Each of the material engagement beams 27 is held in removable position across the upper surface 28 of the respective side frames 14 and 15 by a spaced upstanding guide frame 29 secured to the side frames 14 and 15 as best seen in FIG. 7 of the drawings. Each of the material engagement beams 27 has a corresponding pair of oppositely disposed beam engagement guide posts 30 having a slotted upper position 31 for registering alignment with the ends of the corresponding material engagement beams 27 when the respective lift tables 12 and 13 are in lowered position.

Figure 8:
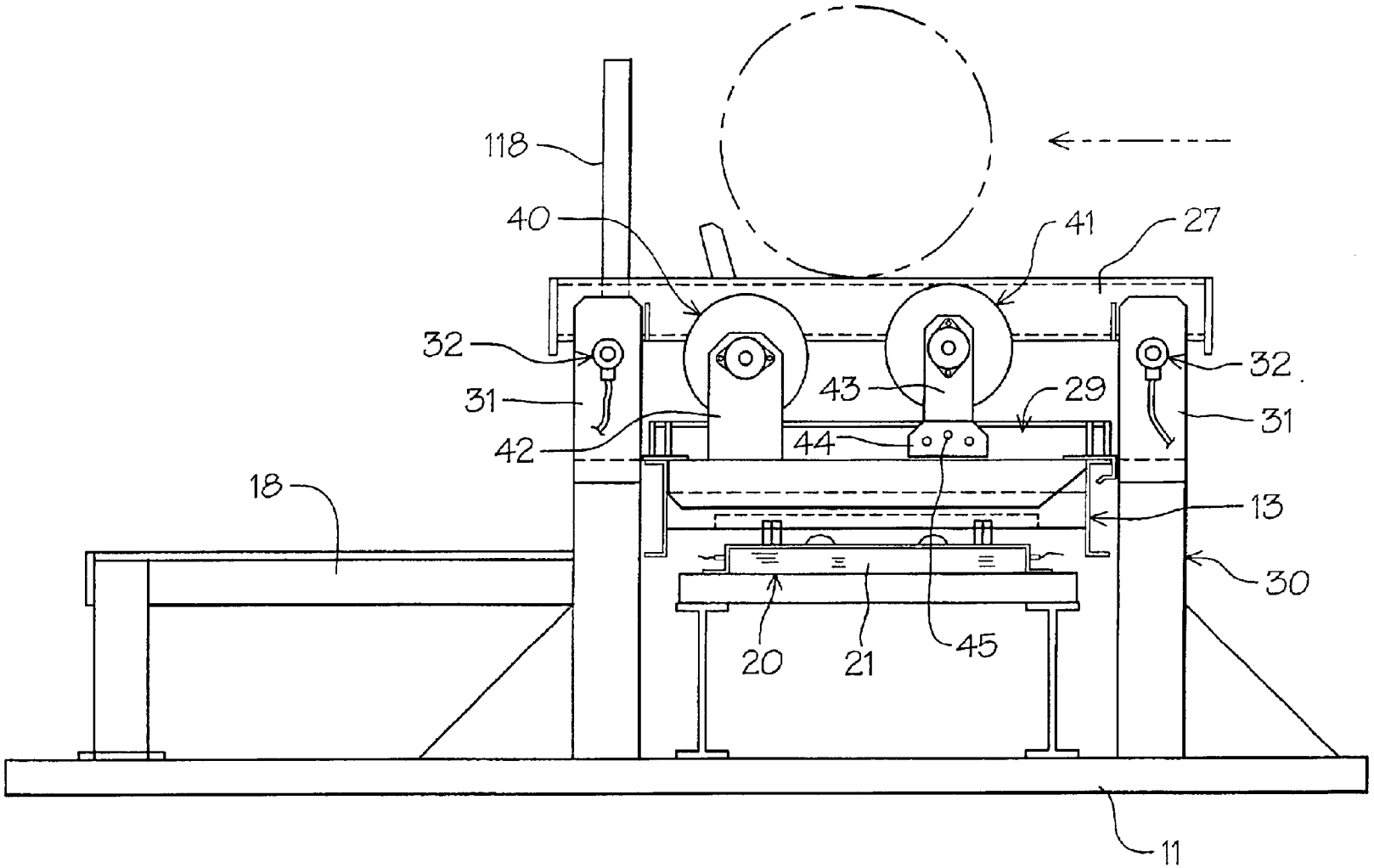
FIG. 8 is an end elevational view of the log-supporting portion of the invention showing the log, in broken lines, positioned on the lift table support beams in load and unload position.
Figure 9:
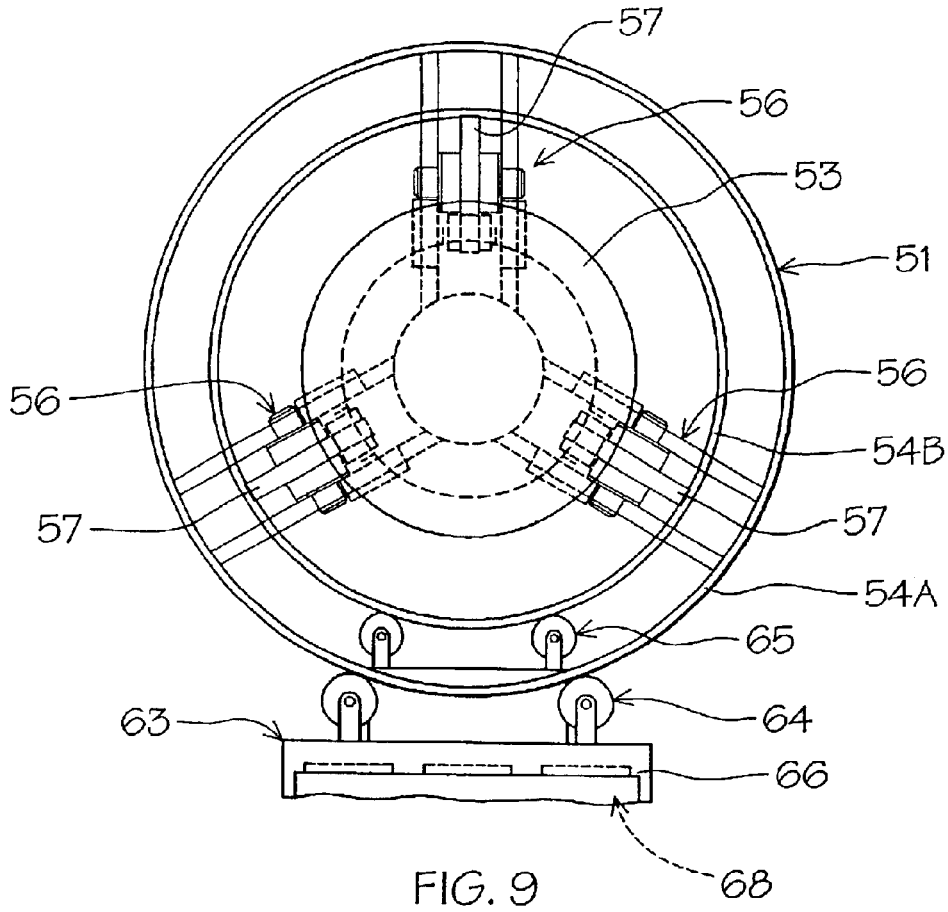
FIG. 9 is an enlarged partial front elevational view of a log engagement chuck.
Figure 10:
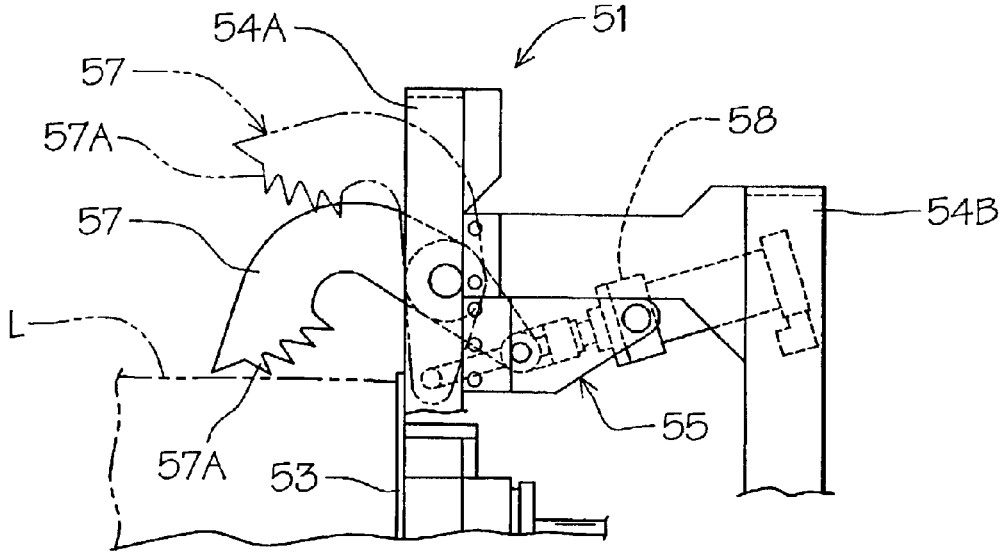
FIG. 10 is an enlarged partial side elevational view of the log engagement chuck with portions broken away.
Figure 23:
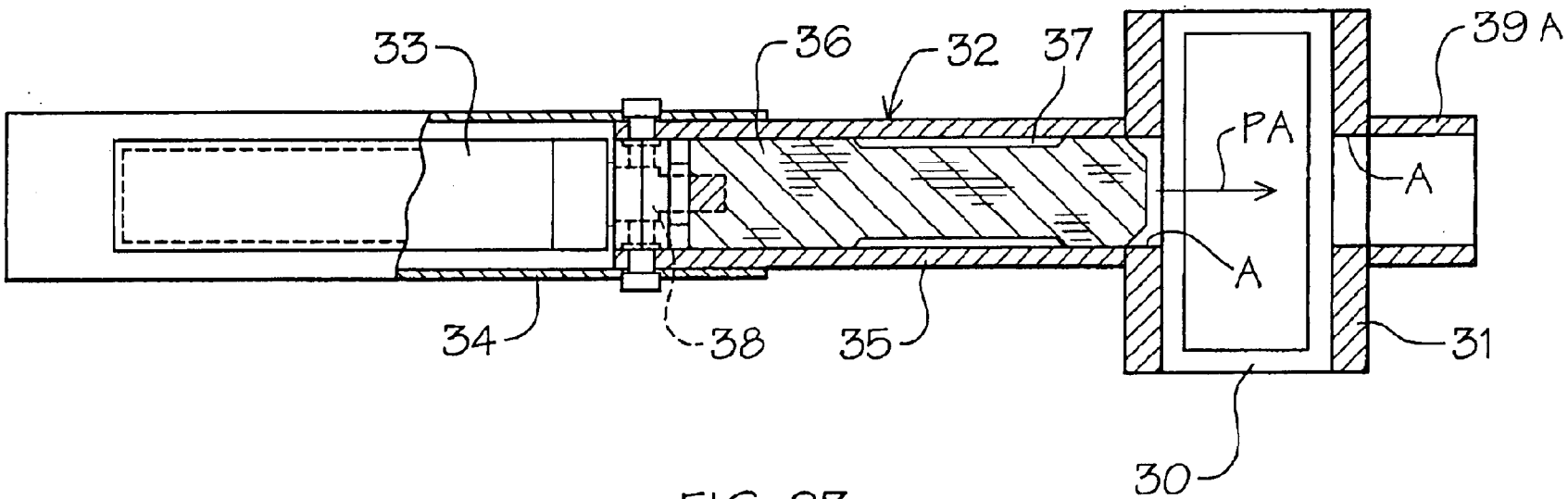
FIG. 23 is an enlarged partial cross-section of a shot pin support assembly.
Figure 25:
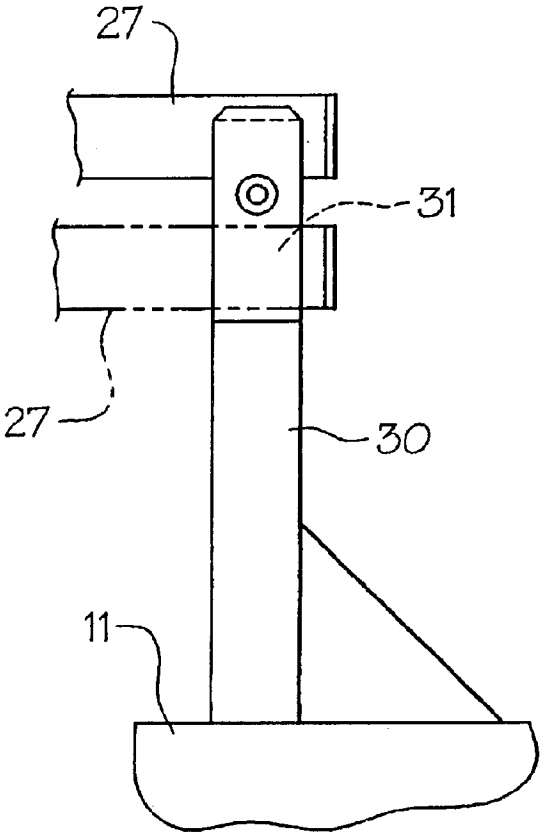
FIG. 25 is a side elevational view of the support post illustrated in FIG. 24.
Figure 24:
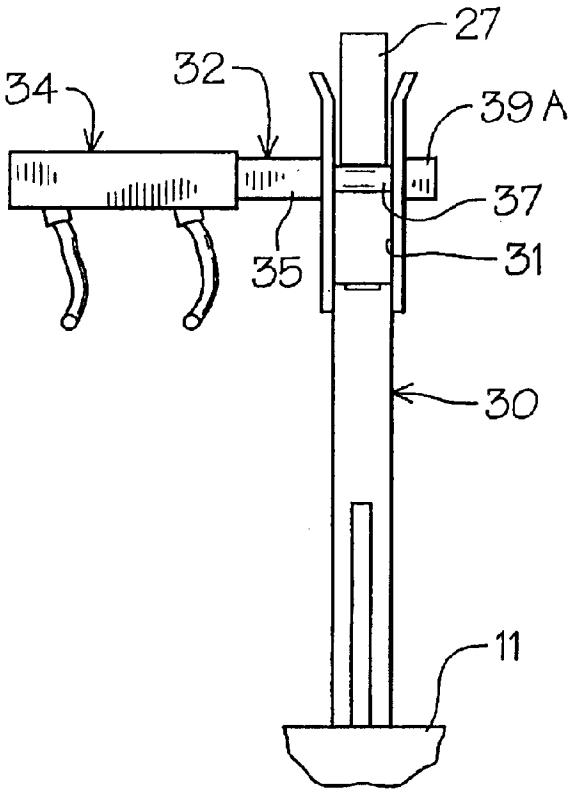
FIG. 24 is a partial front elevational view of a material support post and associated shot pin assembly with a log support beam engaged thereon.

Each of the guide posts 30 have a shot pin assembly 32, best seen in FIGS. 23–25 of the drawings in which a pneumatic cylinder 33 is enclosed within a cylinder guard 34 attached to a pin housing 35. A shot pin 36 has a beam registration area at 37 of reduced diameter and is secured to an activation rod 38 of the cylinder 33. The slotted upper portion 31 of the guide post 30 has aligned apertures A within and a tubular shot pin receiving extension 39A for registration of the shot pin 36 when extended during activation as indicated by the arrow PA and in FIG. 24 of the drawings. With the shot pin 36 extended within the guide post 30, the material engagement beams 27 are held thereon as the respective lift tables 12 and 13 are lowered, as illustrated in FIG. 8 of the drawings. Additionally, it will be evident that with the shot pin 36 retracted, the material engagement beams 27 will remain on the respective lift tables 12 and 13 to a lower guide engagement position illustrated in FIG. 7 of the drawings.

Figure 5:
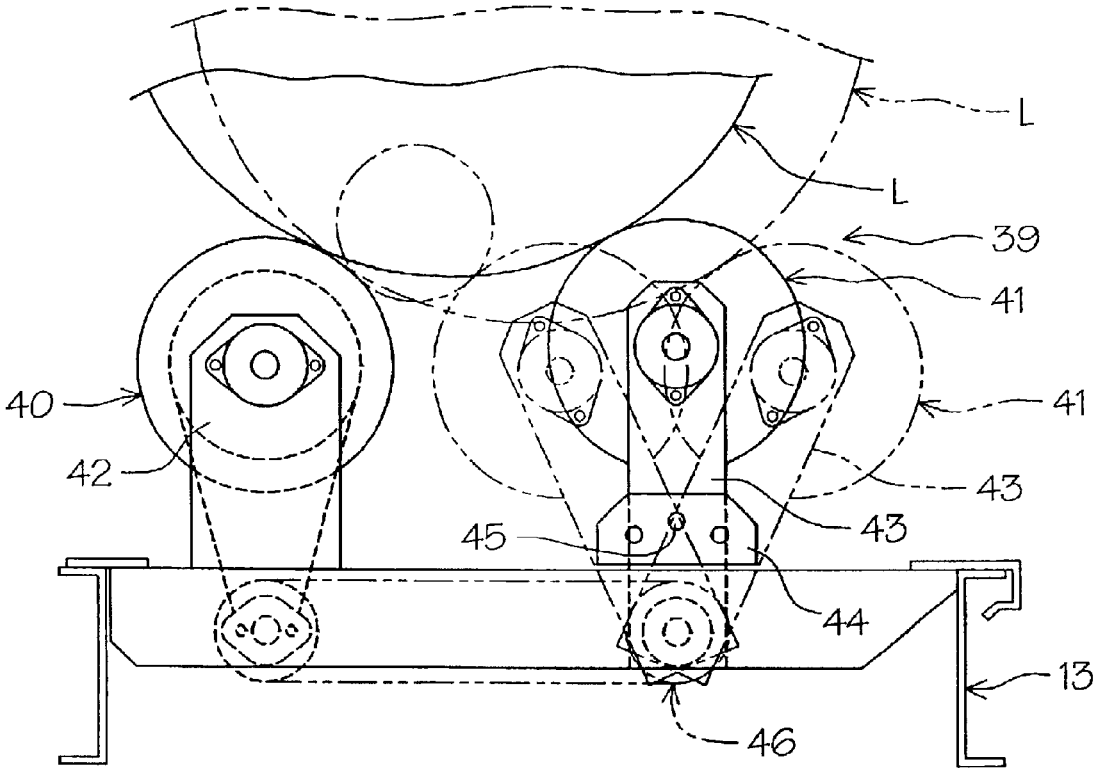
FIG. 5 is an end elevational view of a log engagement roller assembly with a non-powered version shown in solid lines and a power assembly for driving the rollers shown in broken lines and adjustability of the rollers.

Pairs of work piece support roller assemblies are adjustably positioned within the respective lift tables 12 and 13. A first roller assembly pair 39 is positioned adjacent one end of the respective lift tables 12 and 13 and have a fixed roller 40 and a three-position adjustable roller 41. The fixed roller 40 is rotatably mounted on a pair of upstanding mounting brackets 42, as best seen in FIG. 5 of the drawings. The adjustable roller 41 has a pivoted pair of mounting brackets 43 selectively secured between apertured support plates 44 by repositioning engagement pin 45.

It will be evident from the above description that by removing the engagement pin 45 and repositioning the apertured mounting brackets 43 and re-engagement of the pin 45 that the roller 41 can be adjustably positioned as illustrated in broken lines in FIG. 5 of the drawings.

Figure 6:
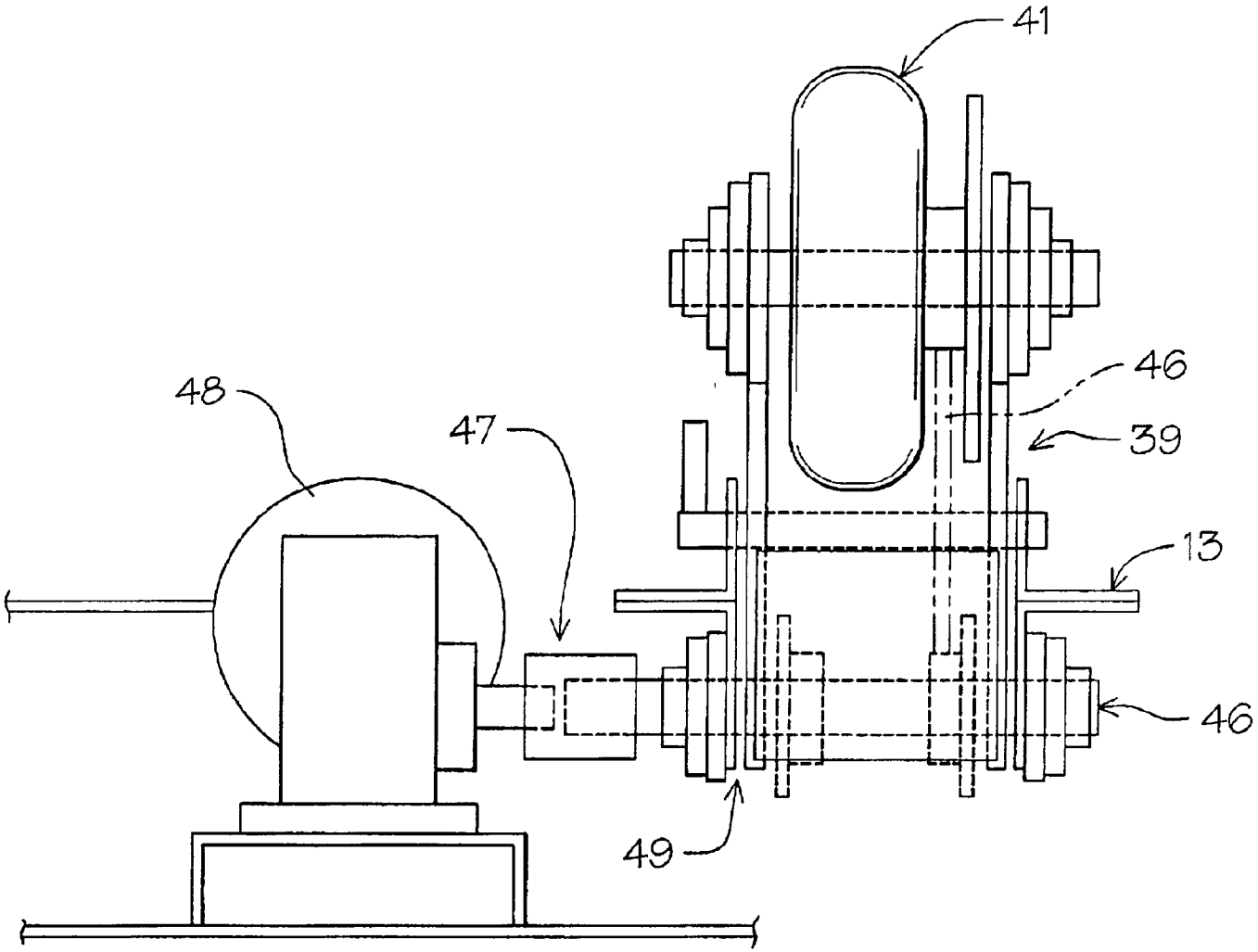
FIG. 6 is an enlarged side elevational view of the drive assembly of the log engagement rollers as seen in FIG. 5 of the drawings.

The respective roller assembly 39 on each of the lift tables is power driven by respective drive sprocket and drive chain assembly 46 interconnecting both rollers 40 and 41 to a gear reduction box 47 and drive motor 48 via a coupling 49 as seen in FIG. 6 of the drawings.

The respective powered roller assemblies 39 are repositionable adjacent the respective end frames 16 and 17 of the lift tables in accordance with use requirements which will be discussed in greater detail hereinafter. A second roller assembly pair 50 has fixed and adjustable roller supports corresponding to the first roller assembly, but is not power driven as hereinbefore described. The roller assemblies 50 are repositionable respectively anywhere along the respective lift tables longitudinal length 12 and 13 to be configured to a given log length, as noted above.

Referring now to FIGS. 3, 4, 9, 10, 20 and 21 of the drawings, a log engagement and rotating chuck assembly 51 can be seen positioned at one end of the main support base frame 11.

The log engagement chuck assembly 51 has an annular material engagement plate 53 positioned within and supported by a pair of annular frame bands 54 and 54B. Multiple power engagement jaw assemblies 56 are secured about the first frame band 54. Each of the power jaw assemblies 56 has a pivoted contour material arm 57 with an engagement jaw end 57A within an interconnected activation piston and cylinder assembly 58 which extends from the secondary support frame assembly 54B.

Figure 11:
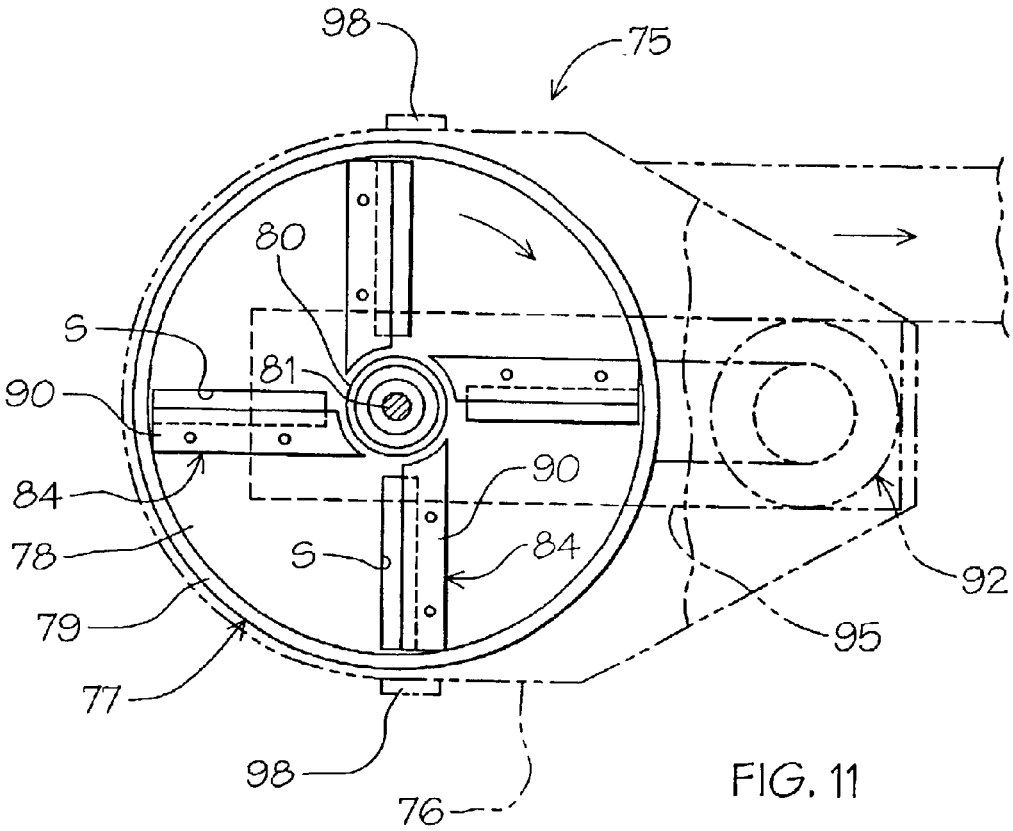
FIG. 11 is a top plan view of a cutting head assembly of the device with portions of the cutting head shown in broken lines.

In operation, the lift tables 12 and 13 are lowered to their lowest position wherein the multiple material engagement beams 27 are held within the corresponding beam engagement guide post pairs on the extended shot pins 36 as hereinbefore described as seen in FIG. 8 of the drawings. A log L to be processed is positioned on the respective material handling beams 27 and up against the engagement plate 53 of the log engagement chuck assembly 51. Upon activation of the respective piston and cylinder assemblies 58, the material engagement jaw assemblies 56 are pivotally advanced for engagement by the jaw end 57A with the log L as best seen in FIG. 11 of the drawings.

A drive shaft 52 extends from the log chuck assembly 51 having universal couplings 52A and 52B to a rotary union 59 on the end of a power support shaft assembly 60. A drive motor 61 and interlinking drive chain 62 selectively rotates the chuck assembly 51 and engaged log L thereon.

Figure 20:
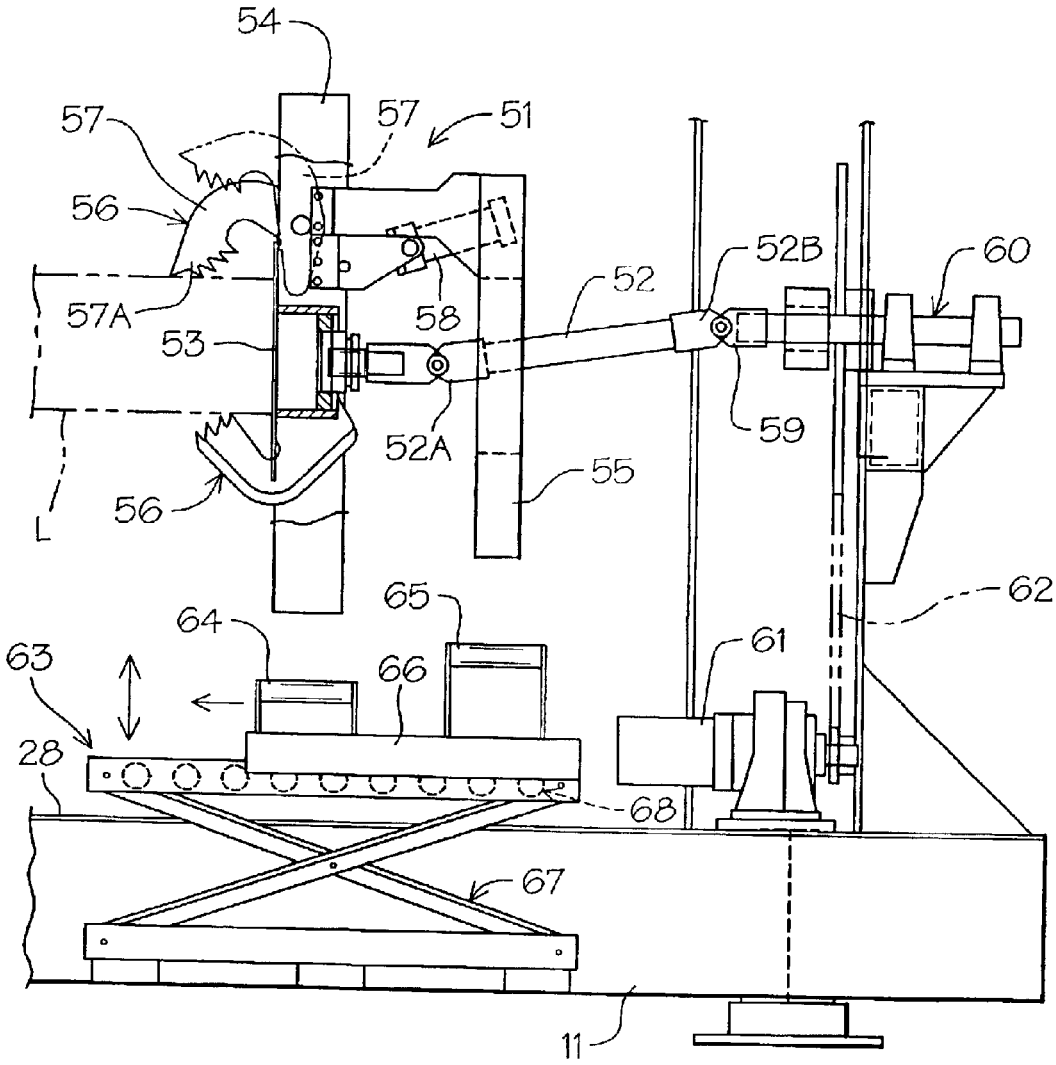
FIG. 20 is an enlarged partial side elevational view of the log chuck assembly and associated interconnected drive and support elements.
Figure 21:
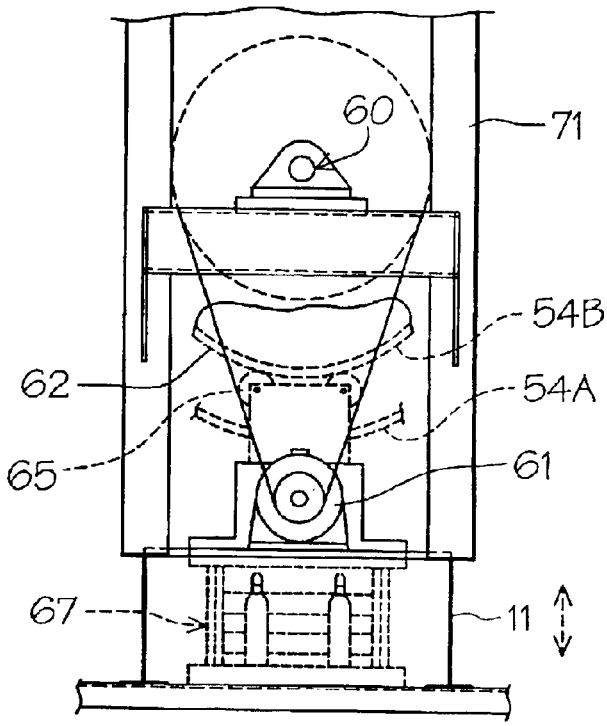
FIG. 21 .is an end elevational view of the chuck drive assembly illustrated in FIG. 20.

Referring now specifically to FIGS. 3, and 20 of the drawings, an adjustable chuck head support stand 63 can be seen wherein pairs of support rollers 64 and 65 are positioned on a sliding alignment frame 66. A powered scissor lift frame assembly 67 extends from the main base support frame 11 having a roller assembly 68 engageable by the alignment frame 66 which can be raised and lowered thereby as best seen in FIG. 20 of the drawings. The respective support roller pairs 64 and 65 are of unequal vertical height to registerably engage the respective annular frame support bands 54A and 54B which are of dissimilar dimensions.

In operation, the log chuck assembly 51 is engaged and supported for vertical adjustment by the support stand 63 so as to be positioned with the log L to be processed which can vary in its end position on the respective lift table 13 when in raised log receiving and removing position as hereinbefore described. Once the log L has been engaged by the chuck assembly 51, the support stand assembly 63 is lowered freeing the chuck 51 for operation. Correspondingly, the lift tables 12 and 13 are raised so that the log L is engaged by the hereinbefore-described drive and idle roller assemblies 39 and 50 respectively.

An overhead frame assembly 69, best seen in FIGS. 1 and 3 of the drawings is formed from a pair of metal trusses 69A and 69B extending between and supported by upstanding end post and beam frames 70 and 71 that extend from respective ends of the main support base frame 11.

The trusses 69A and 69B are interconnected in spaced parallel relation to one another by multiple bracing bars 72. A pair of overhead guide support channels 73 are suspended from respective bottom cords 74 of the trusses 69, best seen in FIGS. 19 and 20 of the drawings.

Figure 12:
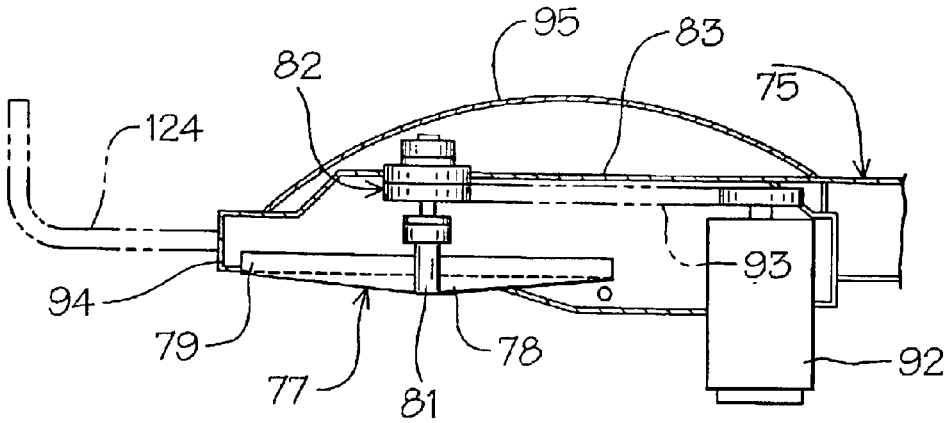
FIG. 12 is a partial side elevational view of the cutting head assembly illustrating the cutting blade and associated interconnected drive elements.

Referring now to FIGS. 11 and 12 of the drawings, a cutter head assembly 75 can be seen having a main housing 76 shown in broken lines with a rotary blade assembly 77 within. The blade assembly 77 has a contoured circular blade support arbor 78 with an upstanding annular perimeter edge flange 79 thereon. A central support frame 80 extends from the support arbor 78 and is secured to a drive shaft 81 having multiple support bearings and drive pulleys 82 and is supported by an interior housing frame element 83, as best seen in FIG. 12 of the drawings.

Figure 17:
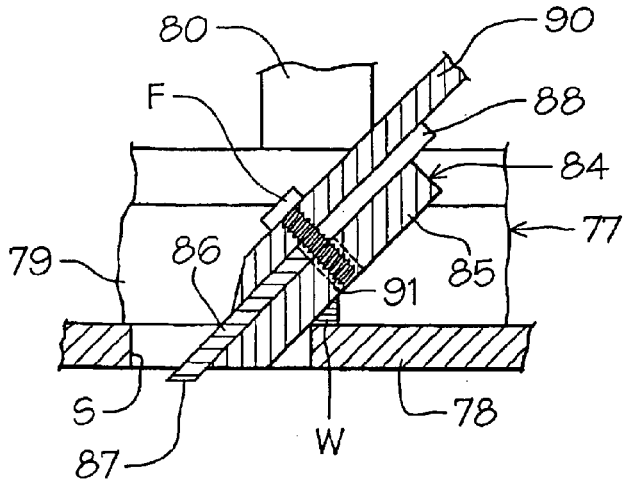
FIG. 17 is an enlarged partial cross-sectional side elevational view of the blade mounting assembly of the cutting head.

The blade arbor 78 has pairs of oppositely disposed annularly spaced blade engagement slots S therein. A blade mounting assembly 84 has an elongated angularly inclined base mounting plate 85 and is secured by welding W to the support arbor 78 within the respective blade opening slots S as best seen in FIG. 17 of the drawings. A rectangular cutting blade 86 can be seen having a chiseled cutting edge 87 and a pair of mounting slots 88 extending inwardly from an edge 89 opposite said cutting edge 87. The cutting blade 86 is aligned on the base plate 85 with a corresponding apertured base retaining clamp plate 90 positioned thereover through which is engaged by a pair of respective threaded fasteners F which are correspondingly registerably secured within a pair of aligned longitudinally spaced threaded apertures 91 within the base plate 85.

It will be seen that the multiple cutting edges 87 of the corresponding blades 86 will extend from the respective slots S for selective engagement with the log L during use.

The blade arbor 78 is driven by a motor 92 mounted within the cutting head housing 76 by corresponding interengaging drive belt 93 as will be well understood by those skilled in the art.

The main housing 76 has a contoured front portion 94 with a central elongated upstanding enclosure 95 thereon covering the hereinbefore-described blade drive mechanism.

Figure 18:
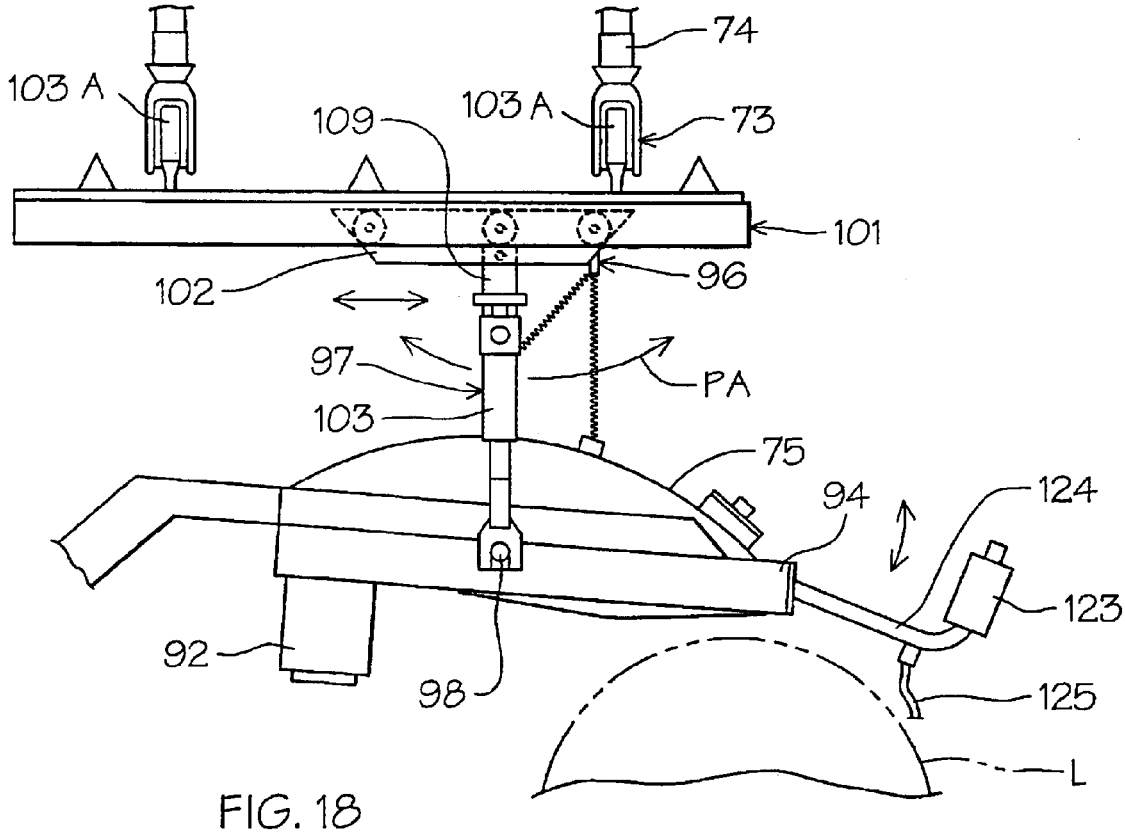
FIG. 18 is a side partial elevational view of the cutting head and support mechanism.
Figure 19:
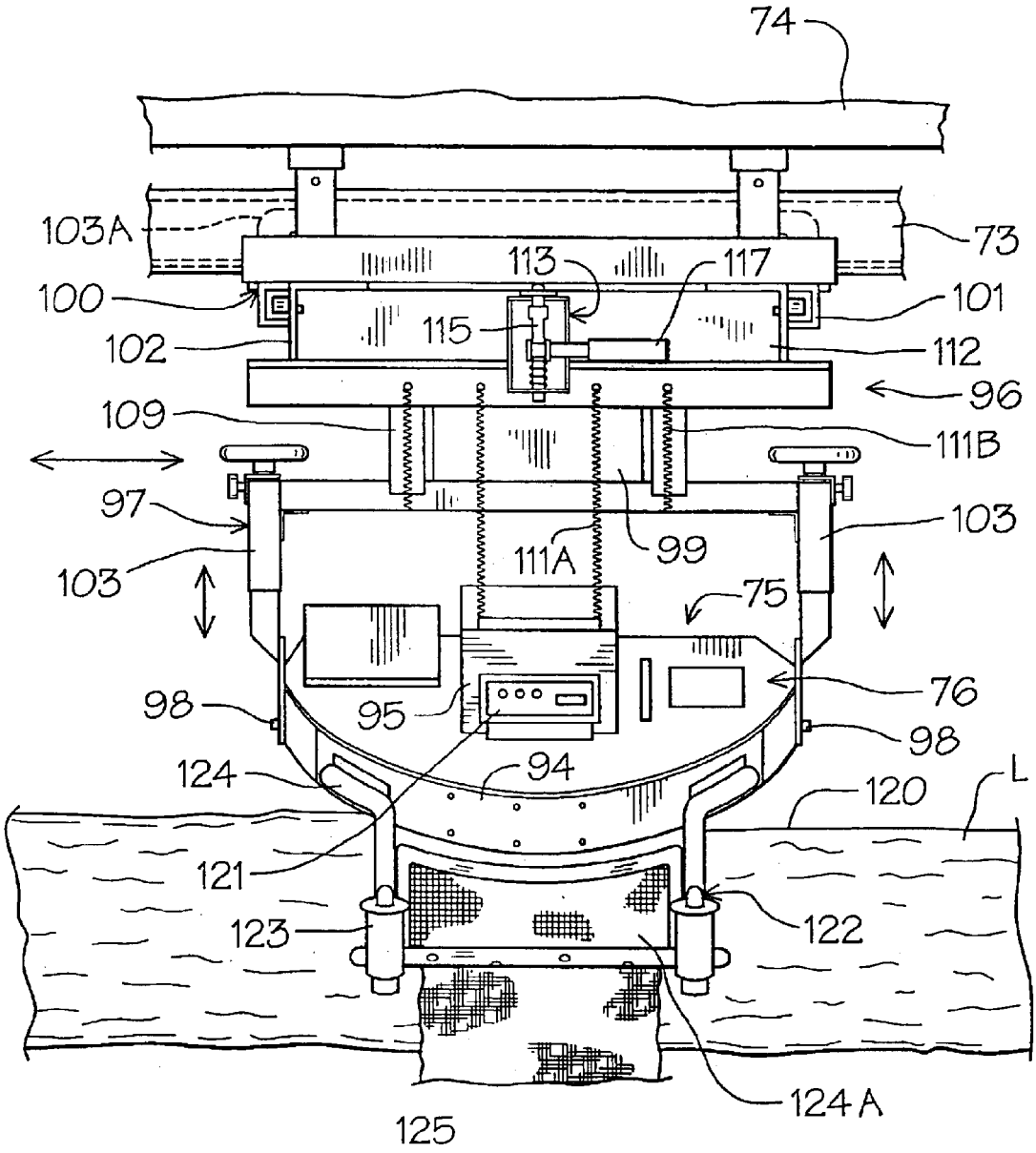
FIG. 19 is a partial front elevational view of the cutting head and head support assembly positioned above a log.

Referring now to FIGS. 18 and 19 of the drawings, the cutting head assembly 75 is movably positioned along the support channels 73 by an adjustable support assembly 96 having a U-shaped suspension bracket 97 extending from the cutting head assembly 75 being pivotally secured thereto by pivot bearings 98 positioned on either side of the housing 76, as best seen in FIGS. 19 and 20 of the drawings. An adjustable mounting frame 99 extends from and is secured to the suspension bracket 97 providing multiple repositioning of the cutting head 75 as will be discussed in greater detail hereinafter.

The adjustable mounting frame 99 has a transverse oriented slide assembly 100 with a pair of oppositely disposed guide tracks 101 with wheeled slide carriages 102 registerable within that allows for the transverse movement of the cutting head assembly 75 as indicated by the arrow in FIG. 18 of the drawings. The guide tracks 101 are in turn suspended from secondary wheeled carriages 103A within the respective overhead support channels 73.

Figure 15:
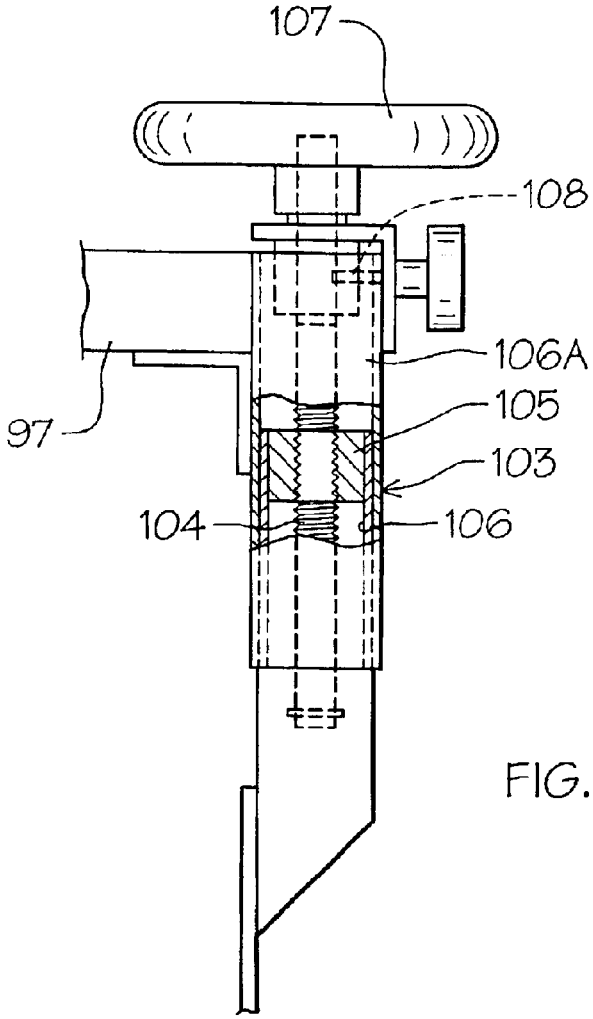
FIG. 15 is an enlarged front elevational view with portions broken away and in section of an angular adjustment assembly for the cutting head support structure.
Figure 16:
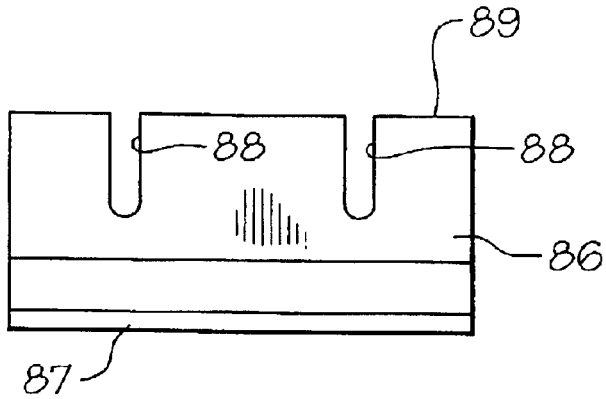
FIG. 16 is an enlarged top plan view of a cutting blade.

The U-shaped suspension bracket 97 has a longitudinal angular adjustment feature defined by a pair of oppositely disposed angular height adjustment assemblies 103. Each of the adjustment assemblies 103 as seen in FIG. 15 of the drawings has an internally threaded rod 104 that is registerable within a traveling mounting block 105 fixed within a tubular extension 106 telescopically extensible from within the main suspension bracket support portions 106A. The threaded rod 104 is rotated by a manual adjustment wheel 107 with an associated locking pin 108 which when advanced prevents the rod 104 from rotating. The angular height adjustment assemblies 103 are independently adjustable and thus impart up to a five degree horizontal angular inclination to the cutting head assembly 75 in relation to the adjustable mounting frame 99 as indicated by arrows in FIG. 19 of the drawings.

Figure 13:
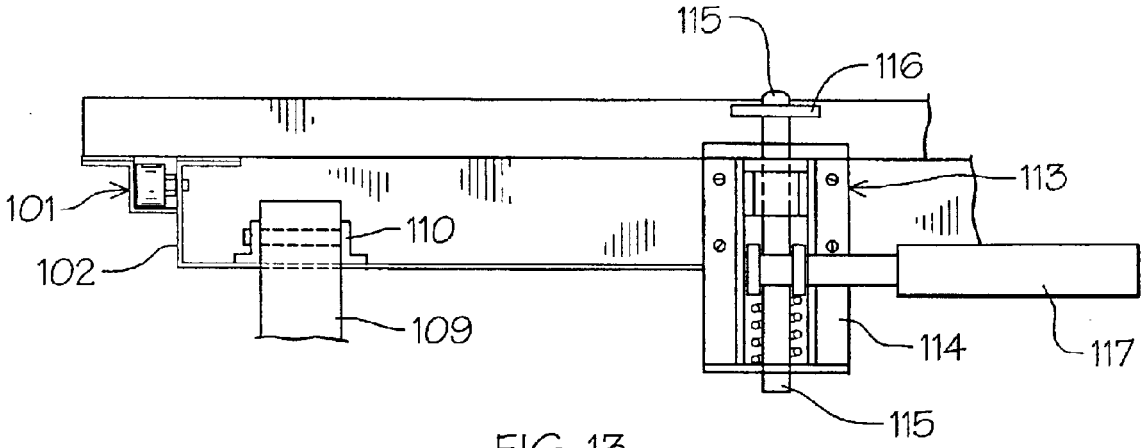
FIG. 13 is an enlarged partial front elevational view with portions broken away of the cutting head adjustment support structure.
Figure 22:
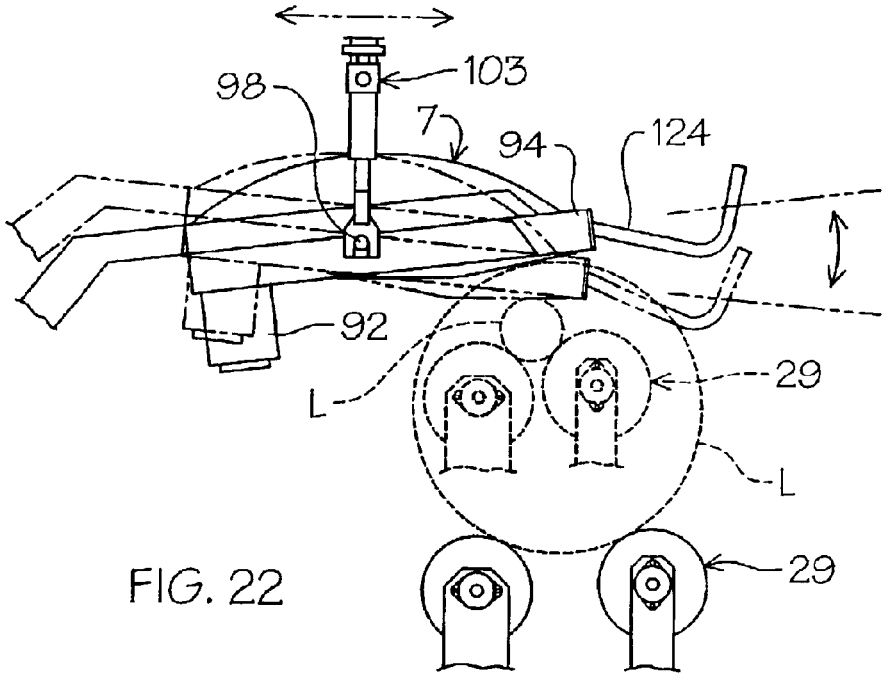
FIG. 22 is a graphic representation of the adjustable angles achieved by the cutting head assembly for engagement with the log in both solid and broken lines.

Referring now to FIGS. 13, 15 and 19 of the drawings, the cutting head 75 is pivoted on an arcuate axis indicated by arrow PA by support frame extensions 109 that are pivotally positioned on a pair of bearing block assemblies 110 within the slide assembly. This will allow for arcuate readjustment of the cutting head U-shaped suspension bracket 97 so as to help conform to the log engagement inclinations when necessary as illustrated in FIG. 22 of the drawings.

The cutting head housing 76 accordingly is spring biased by a pair of springs 111, 111A and 111B from the adjustable support assembly 96 as best seen in FIG. 19 of the drawings.

It will be evident from the above description that the cutting head assembly 75 can be moved in multiple horizontal, longitudinal and arcuate planes along the overhead head support trusses as well as transversely for and aft as indicated by the directional arrows as noted in FIGS. 18 and 19 of the drawings.

Figure 14:
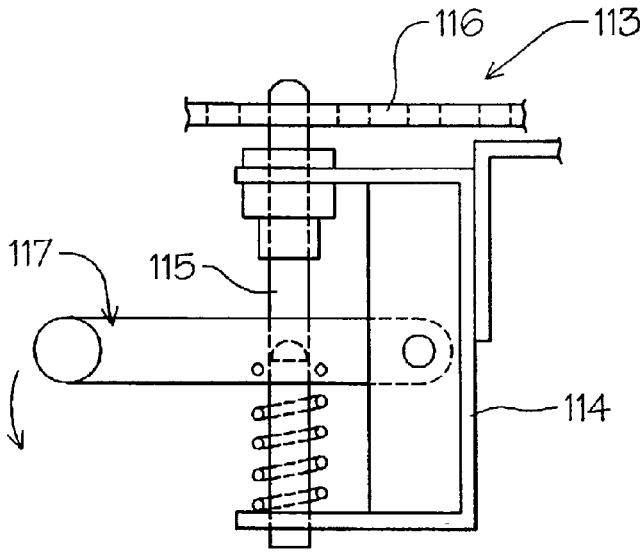
FIG. 14 is an enlarged side elevational view of an indexing pin and handle assembly for repositioning the cutting head in relation to the log.

Referring now to FIGS. 13, 14, and 19 of the drawings, an indexing locking pin assembly 113 is shown utilized to incrementally position and lock the cutting head assembly 75 in its transverse movement across the support head surface frame as noted above. The locking pin assembly 113 has a U-shaped mounting bracket 114 with a spring urged pin 115 which is arranged for registration within a multiply apertured indexing bracket 116 thereabove. A handle assembly 117 is used both to unlock the pin 115 and move the head assembly along the hereinbefore-described guide tracks 101 and then lock the cutting head assembly in its new position indicated by the actuation arrows in FIG. 19 of the drawings.

In operation, as noted above, the log L is positioned onto the elevated material support beams 27 as seen in FIG. 8 of the drawings. Multiple extensible safety stakes 118 have been telescopically extended from tubular stakeholders 119 adjacent some of said respective guideposts 30.

The end of the log L is then engaged against the chuck assembly 51 and held by the multiple power jaws 56 extending there from. The lift tables 12 and 13 are raised to engage the log L with respective roller assemblies 39 and 50, and the chuck support stand 63 is lowered and the multiple material cross beams 27 are held in their respective beam fittings 29. The shot pins 36 are retracted from the guideposts 30 as seen in broken lines in FIG. 7 of the drawings. This allows the lift tables to be selectively raised and lowered to maintain log engagement with the cutting head 75 which is in turn adjustable in multiple horizontal and angular defined planes as set forth hereinbefore.

Referring now to FIGS. 19 and 22 of the drawings, the cutting head 75 can be seen to be engaging the log L with multiple cutting blades spinning at high speed while being moved longitudinally along the overhead support channels 73. The cutting head 75 can be repositioned in multiple vertical and horizontal planes as hereinbefore described so as to follow the varying contours of the log L removing longitudinal strips of bark indicated at 120 in FIG. 19 of the drawings. As noted, the log L can be raised and lowered by the lift tables 12 and 13 to maintain contact with the cutting head 75 and be incrementally rotated by the activation of the chuck assembly 51 or power rollers 39 to reposition a new section of the log L to be stripped by the cutting head 75.

The operator, not shown, can control both the position of the log L vertically and rotatably and the cutting head 75 from multiple controls 121 and 122 positioned on the cutting blade housing and on oppositely disposed extending handles 123 that extend outwardly from the housing 76 on support arms 124, a safety screen 124A and flexible flap 125 extend between the support arms 124.

The log-peeling machine 10 can accommodate a variety of log sizes, both in diameter and length. The log engagement rollers 29 and 50, as described, can be adjusted in both longitudinal spaced relation to one another within each assembly to accommodate larger or smaller diameter logs as illustrated generally in solid and broken lines in FIG. 5 of the drawings.

Figure 26:
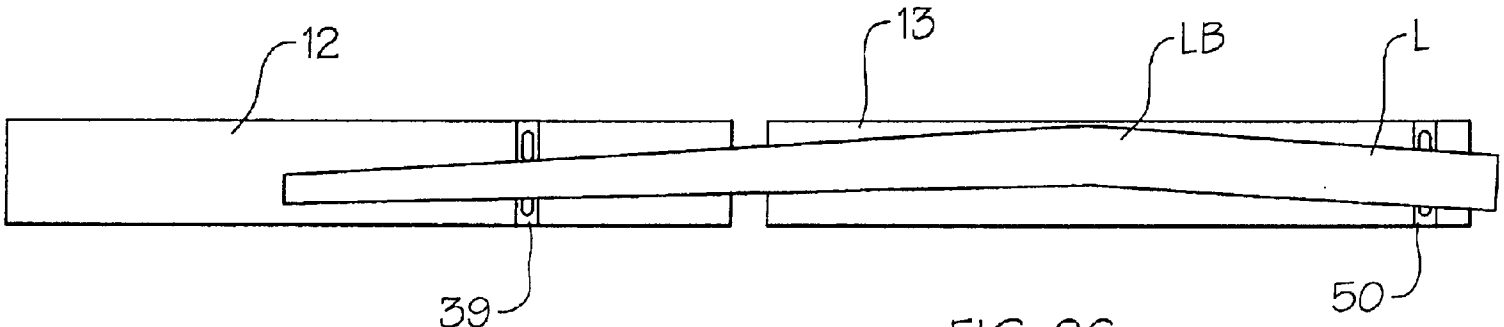
FIG. 26 is a graphic top plane representation of the log support lift tables with an irregular log positioned thereon.
Figure 27:
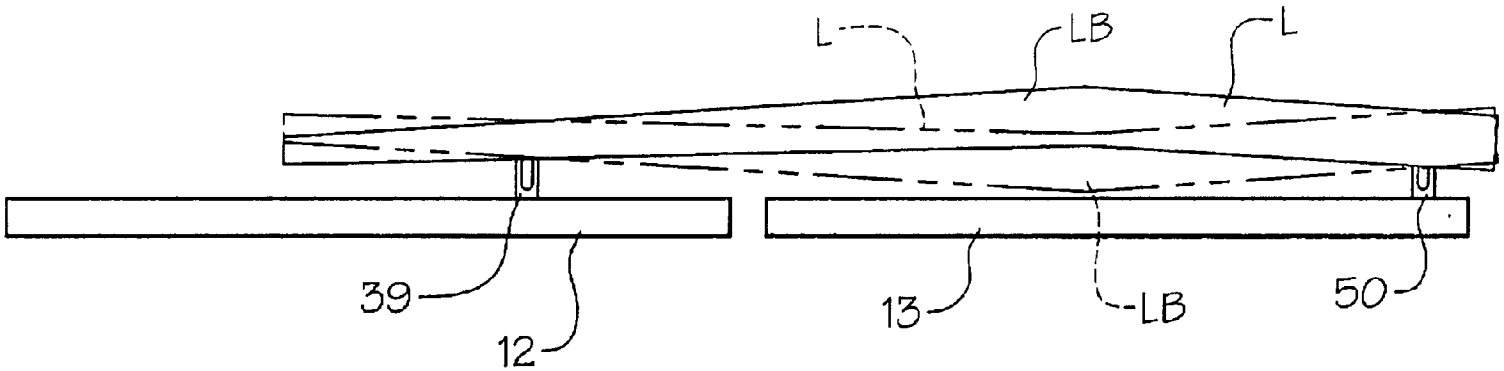
FIG. 27 is a graphic side elevational representation of the log lift tables showing an irregular log representation thereon in solid and broken lines.

The length of the log L and longitudinal bow LB, if any, can be generally accommodated by the relative positioning of the roller assemblies 29 and 50 on the respective lift tables 12 and 13 and their associated orientation therewith as graphically illustrated in FIGS. 26 and 27 of the drawings.

In FIG. 26 of the drawings, a top graphic illustration is shown in which the two lift tables 12 and 13 have a log L positioned thereon with a longitudinal bow LB along its length. This illustrates the nature of repositioning the respective roller assemblies and the fact that the machine will accommodate for a variety of angularly disposed log lengths within.

FIG. 27 illustrates a graphic side elevational view showing how the log can be rotated on its longitudinal axis even when having a certain degree of longitudinal bend LB therein as shown in both solid and broken lines.

Given that the log L can be rotated by the chuck assembly 51 and also by the power rollers 50 it will be advisable in some situations to unchuck the log L after the majority of bark has been removed and simply rotate the log L by the associated power rollers 50 and the finish the bark removal to the end of the logs.

Since there are two lift tables 12 and 13 and associated powered and non-powered roller assemblies 29 and 50 respectively associated with each table a second cutting head and chuck assembly, (not shown), may be added so that two independent log peeling operations can be undertaken simultaneously within the confines of the length of the tables relative to the length of the logs as will be evident to those skilled in the art.

A main control and power source panel (not shown) is positioned within the main base support frame adjacent in this example to the primary chuck assembly 51. Power lines PL extend outwardly therefrom to the movable cutting head assembly 75 on a plurality of side guided clips 125 that extend from one of the guide channels as hereinbefore described.

It will be evident from the above description that by the nature of the orientation of the scissor lifts 18 and 19 at the respective end of each of the lift tables 12 and 13 that the tables can be lifted in tandem together at the same rate independently or alternately from end to end within a given range so that an angular inclination of each lift table can be imparted.

In the loading and unloading of a log for processing on the log peeling device 10 of the invention, multiple pairs of safety stakes, as noted, are used initially on one side of the respective lift tables 12 and 13 as the log L is loaded thereon and repositioned for engagement with the log chuck 51, if required. The second set of stakes on the opposite side of the lift tables 12 and 13 are then inserted as a safety precaution to prevent the log L from rolling off the machine and onto the operator.

The log processing sequence then follows in which, as noted, the lift tables 12 and 13 are elevated so that the log is engaged by the respective powered and non-powered roller assemblies 39 and 50 lifting the log from the support beams 27 which are then engaged by the brackets on the lift tables and held in spaced relation to the log.

The shot pins 36 are then retracted from the plurality of oppositely disposed pairs of guide posts as hereinbefore described and the lift tables 12 and 13 can then be lowered and raised as required with respective material support beams 27 traveling at their lower most position freely within the guide slots 31 of the guide posts 30 allowing for the proper repositioning of the log L in relation to the overhead cutting head assembly 75 as it is moved longitudinally along the surface of the log as hereinbefore described.

It will thus be apparent to those skilled in the art that various changes and modifications may be made therein without departing from the spirit of the invention.

We claim:

1. A log peeling apparatus comprising an elongated rigid base support frame, a lift table within said base support frame, multiple log engagement rollers on respective upstanding support brackets one of which is pivotally adjustable on said lift table, a log chuck at one end of said base support frame for engaging with and rotating a log about its longitudinal axis, said log chuck having a central plate within a support frame, multiple jaws on said central plate, a cutting head assembly having an arbor disk with a plurality of cutting blades extending therefrom within a housing for removing bark from the log in sequential longitudinal strips, said cutting blades adjustably positioned on a blade base support, a rotating plate overlying said blade secured to said base support, a cutting head support carriage having a U-shaped suspension bracket slidably positioned within overhead guide support channels extending from an overhead frame on said base support frame for moving the cutting head in longitudinal and transverse horizontal planes relative to said log, a plurality of log support means selectively positioned on said lift tables from a first non-log engagement position on said table to a second log engagement position in spaced relation to said lift tables, oppositely disposed beam engagement guide and support posts extending from said base support frame, slot pins in said beam engagement guides and said support posts registerable with respective beams when in said first non-log engagement position on said tables and in said second log engagement position in spaced relation to said tables, one of said log engagement rollers are rotatably driven.

2. The log peeling apparatus set forth in claim 1 wherein said lift tables comprise, an elongated rectangular frame having scissor lift assemblies engageable within said lift tables and said base support frame.

3. The log peeling apparatus set forth in claim 1 wherein said selective log supporting means on said lift tables comprises, a plurality of longitudinally spaced material engagement beams extending transversely there across, beam engagement brackets on said lift tables.

4. The log peeling apparatus set forth in claim 1 wherein said central plate of said log chuck is rotated by motor means in communication therewith.

* * * * *